United States Patent [19]

Williams

[11] Patent Number: 4,996,771

[45] Date of Patent: Mar. 5, 1991

[54] NAIL CLIPPER RETAINER

[76] Inventor: Craig A. Williams, R.D. #1 Box 1040, Little Marsh, Pa. 16931

[21] Appl. No.: 532,661

[22] Filed: Jun. 4, 1990

[51] Int. Cl.[5] ..... A45D 29/02

[52] U.S. Cl. ..... 30/28; 132/75.5

[58] Field of Search ..... 30/28, 29, 131, 132, 30/124; 132/75.5

[56] References Cited

U.S. PATENT DOCUMENTS 4,150,481 4/1979 Min ..... 30/28

4,219,929 9/1980 Min ..... 30/28

*Primary Examiner*—Douglas D. Watts

*Attorney, Agent, or Firm*—Michael I. Kroll

[57] ABSTRACT

A nail clipper retainer is provided and consists of a mechanism for catching nail clippings and a structure for slideably attaching the catching mechanism to a body of a nail clipper. When the catching mechanism is in a forward position on the body it will catch the clipped nails. When the catching mechanism is in a rearward position on the body it will allow the clipped nails to be emptied therefrom.

5 Claims, 1 Drawing Sheet

NAIL CLIPPER RETAINER

BACKGROUND OF THE INVENTION

1. Field of the Invention

The instant invention relates generally to manicuring equipment and more specifically it relates to a nail clipper retainer.

2. Description of the Prior Art

Numerous manicuring equipment have been provided in prior art that are adapted to be used for the treatment of the hands and fingernails, including shaping, cleaning, polishing and clipping of the nails. While these units may be suitable for the particular purpose to which they address, they would not be as suitable for the purposes of the present invention as heretofore described.

SUMMARY OF THE INVENTION

A primary object of the present invention is to provide a nail clipper retainer that will overcome the shortcomings of the prior art devices.

Another object is to provide a nail clipper retainer that will prevent cut fingernails and toenails from flying all over while a nail clipper is being used for clipping the nails.

An additional object is to provide a nail clipper retainer that can slide forward and backward on the body of the nail clipper so that when the retainer is in the forward position it will catch the clipped nails and when the retainer is in the backward position it will allow the clipped nails to be emptied therefrom.

A further object is to provide a nail clipper retainer that is simple and easy to use.

A still further object is to provide a nail clipper retainer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
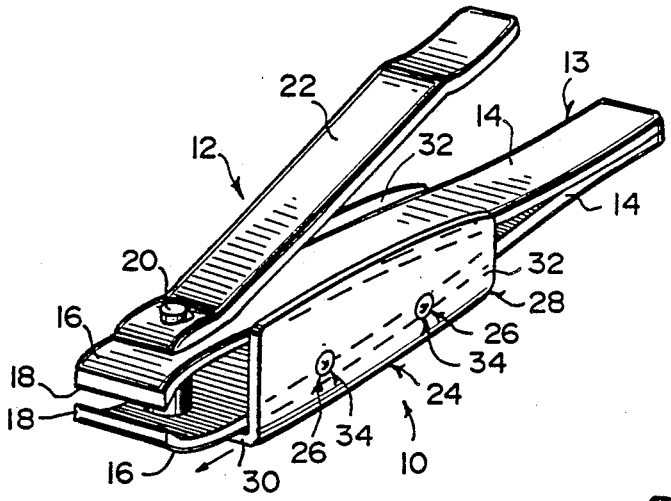
FIG. 1 is a perspective view of a nail clipper with the invention thereon in a rearward position.
Figure 2:
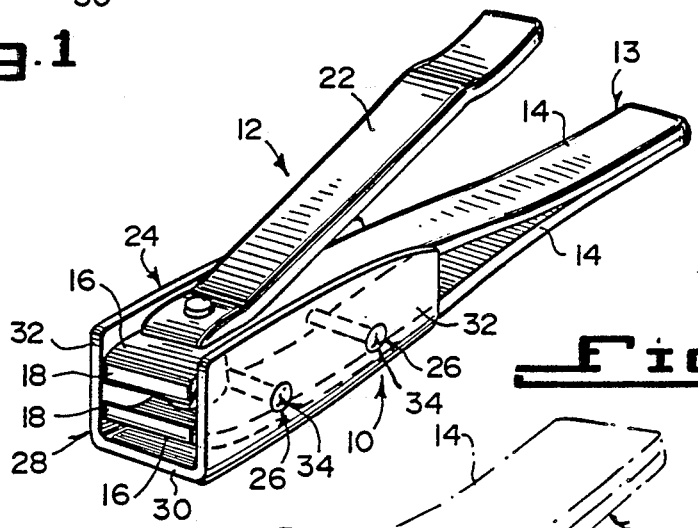
FIG. 2 is a perspective view of the nail clipper with the invention therein in a forward position.
Figure 3:
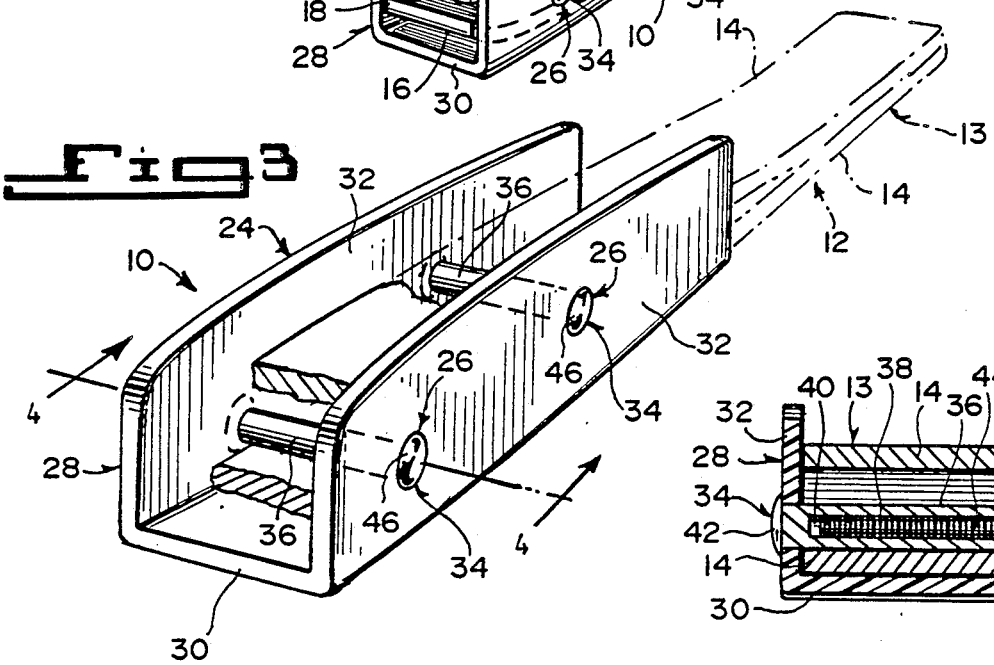
FIG. 3 is an enlarged perspective view of the invention with the nail clipper broken away and in phantom.
Figure 4:
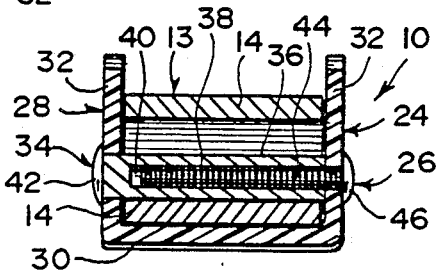
FIG. 4 is a cross sectional view taken along line 4—4 in FIG. 3.

Turning now descriptively to the drawings, in which similar reference characters denote similar elements throughout the several views, the Figures illustrate a nail clipper retainer 10 for a typical nail clipper 12 of the type that includes a body 13 with a pair of legs 14, each having a jaw 16 with a cutting edge 18, a pin 20 and a lever 22. The retainer 10 consists of a mechanism 24 for catching nail clippings and the structure 26 for slideably attaching the catching mechanism 24 to the body 13 of the nail clipper 12. When the catching mechanism 24 is in a forward position on the body 13 (see FIG. 2) it will catch the clipped nails. When the catching mechanism 24 is in a rearward position on the body 13 (see FIG. 1) it will allow the clipped nails to be emptied therefrom.

The catching mechanism 24 is an elongated U-shaped member 28 having a bottom wall 30 and two side walls 32 that will fit under and on the sides of the body 13 of the nail clipper 12. The slideably attaching structure 26 includes two fasteners 34 spaced apart and extending through the two side walls 32 of the elongated U-shaped member 28 so as to slideably capture the bottom leg 14 of the body 13 of the nail clipper 12 between the fasteners 34 and the bottom wall 30 of the elongated U-shaped member 28.

Each fastener 34 includes a sleeve 36 and a bolt 38. The sleeve 36 has an internally threaded bore 40 and an enlarged head 42, while the bolt 38 has an externally threaded shaft 44 and an enlarged head 46, wherein the shaft 44 threadably engages with the threaded bore 40.

The elongated U-shaped member 28 is fabricated out of a durable plastic material, while each sleeve 36 and bolt 38 are fabricated out of a durable metal material.

LIST OF REFERENCE NUMBERS

10 nail clipper retainer
12 nail clipper
13 body
14 leg of 13
16 jaw on 14
18 cutting edge on 16
20 pin
22 lever
24 catching mechanism
26 slideably attaching structure
28 elongated U-shaped member
30 bottom wall of 28
32 side wall of 28
34 fastener
36 sleeve
38 bolt
40 internally threaded bore in 36
42 enlarged head on 36
44 externally threaded shaft on 38
46 enlarged head on 38

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A nail clipper retainer comprising:

(a) means for catching nail clippings; and (b) means for slidably attaching said catching means to a body of a nail clipper so that when said catching means is in a forward position on the body it will catch the clipped nails and when said catching means is in a rearward position on the body it will allow the clipped nails to be emptied therefrom.

wherein said catching means is an elongated U-shaped member having a bottom and two side walls that will fit under and on the sides of the body of the nail clipper.

2. A nail clipper retainer as recited in claim 1, wherein said slideably attaching means includes two fasteners spaced apart and extending through the two side walls of said elongated U-shaped member so as to slideably capture the bottom leg of the body of the nail clipper between said fasteners and the bottom wall of said elongated U-shaped member.

3. A nail clipper retainer as recited in claim 2, wherein each said fastener includes:

(a) a sleeve having an internally threaded bore and an enlarged head; and (b) a bolt having an externally threaded shaft and an enlarged head wherein said shaft threadably engages with said threaded bore.

4. A nail clipper retainer as recited in claim 3, wherein said elongated U-shaped member is fabricated out of a durable plastic material.

5. A nail clipper retainer as recited in claim 4, wherein each said sleeve and said bolt are fabricated out of a durable metal material.

* * * * *